343-754 SR
9/8/81 OR 4,288,795

United States Patent [19]

Shelton

[11] 4,288,795

[45] Sep. 8, 1981

[54] ANASTIGMATIC THREE-DIMENSIONAL BOOTLACE LENS

[75] Inventor: J. Paul Shelton, Arlington, Va.

[73] Assignee: The United States of America as represented by the Secretary of the Navy, Washington, D.C.

[21] Appl. No.: 88,191

[22] Filed: Oct. 25, 1979

[51] Int. Cl.[3] ..... H01Q 19/06

[52] U.S. Cl. ..... 343/754; 343/911 L

[58] Field of Search ..... 343/754, 854, 911 L, 343/911 R

[56] References Cited

U.S. PATENT DOCUMENTS 3,230,536 1/1966 Cheston ..... 343/754

*Primary Examiner*—Eli Lieberman
*Attorney, Agent, or Firm*—R. S. Sciascia; William T. Ellis; Melvin L. Crane

[57] ABSTRACT

A three-dimensional bootlace lens with minimum possible focusing aberrations, minimum possible focusing size and minimum possible dielectric loading. The feed and lens surfaces are in the shape of a spherical cap and covered by contiguous arrays of radiators. The region between the inner surfaces of the lens is filled with a nonuniform dielectric material with an index of refraction which constantly changes from the center line outwardly. Lens ports are connected to a radiating antenna array by means of coaxial transmission lines all of which have the same length. The axial feed point has a focusing performance which is perfect. For all other points the lens is free of all first-order aberrations except coma. The outputs of the lens can be used to feed a planar radiating antenna array so as to produce a multiple directive beam in one angular dimension or to feed a circular array so as to make it amenable to scanning or multibeam feed systems that are used with linear arrays.

6 Claims, 7 Drawing Figures

ANASTIGMATIC THREE-DIMENSIONAL BOOTLACE LENS

BACKGROUND OF THE INVENTION

This invention relates to a bootlace-type lens used to feed a planar radiating antenna array and more particularly to a small-size, three-dimensional bootlace lens having very little, if any, aberrations.

Prior-art antennas have been made in various shapes, sizes and for different frequencies of operation. Various types of lens have been used to feed the various types of antennas and to receive signals from an antenna due to incident radiation.

The bootlace lens was developed by H. Gent in 1956 as set forth in the following: (1) "*The Bootlace Aerial*", Royal Radar Establishment J., pp. 47–57, Oct. 1957; and (2) British Pat. No. 25,926/56 Aug. 1956 by Gent et al. Such a lens uses a planar homogeneous wave-transmission region which has a set of feed ports on one side and a set of lens ports on the other. For the case in which the radiator array is constrained to a straight line, it has been shown that perfect focus can be obtained at three points on the feed curve, as set forth in an article, "Two-dimensional Symmetric Bootlace Lenses", *IEEE Trans. Antennas Propagation,* Vol. Ap 13, pp. 521–528, July 1965.

Design equations of the bootlace lens were presented by Rotman and Turner, in 1963, and they also gave examples of aberration characteristics in an article, "Wide-angle microwave lens for line source Applications", *IEEE Trans. Antennas Propagation,* Vo. AP-11, No. 6, pp. 623–632, Nov. 1963. Archer has described applications of the lens in an article, "Lens-fed Multiple-beam Arrays", Microwave, Vol. 18, No. 10, pp. 37–42, Oct. 1975. Whereas the primary intended application of the lens in the 1950's was for rapid mechanical scan by means of feed motion, recent interest has been based on the lens' capabilities as a multiple-beam system. Gent lenses have been used recently in experimental precision aircraft landing systems in Australia and the United States which has been set forth in an article, "MLS-A Practical Application of Microwave Technology", *IEEE Trans. Microwave Theory Tech.,* Vol. MTT-24, No. 12, pp. 964–971, Dec. 1976.

Rotman and Turner required that the feed curve be circular, and optimized the design parameters accordingly. This was consistent with rapid mechanical scan of the feedhorn. In terms of multiple-beam configurations, requiring the feed curve to be a circle is an unnecessary constraint. It has been concluded that there is no limitation on the shape of the feed curve; however, the lens should exhibit front-to-back symmetry.

An unusual two-dimensional bootlace lens has been set forth in U.S. Pat. No. 4,114,162.

SUMMARY OF THE INVENTION

A three dimensional bootlace lens formed by an upper and a lower spherical cap separated by a dielectric material whose dielectric constant varies radially from the center axis outwardly to the outer edge of the caps. One of the spherical caps have feed ports thereon and the other spherical cap has lens ports that feed an antenna. The outputs of the lens are used to feed a planar radiating antenna array so as to produce multiple directive beams in two angular dimensions or to feed a linear array so as to produce multiple directive beams in one angular dimension or to feed a circular array so as to make the array amenable to scanning or multibeam feed systems that are used with linear arrays. Such lenses wil provide the same focusing performance in a smaller size than prior art lenses or it will provide better performance in the same size.

DETAILED DESCRIPTION

Figure 5:
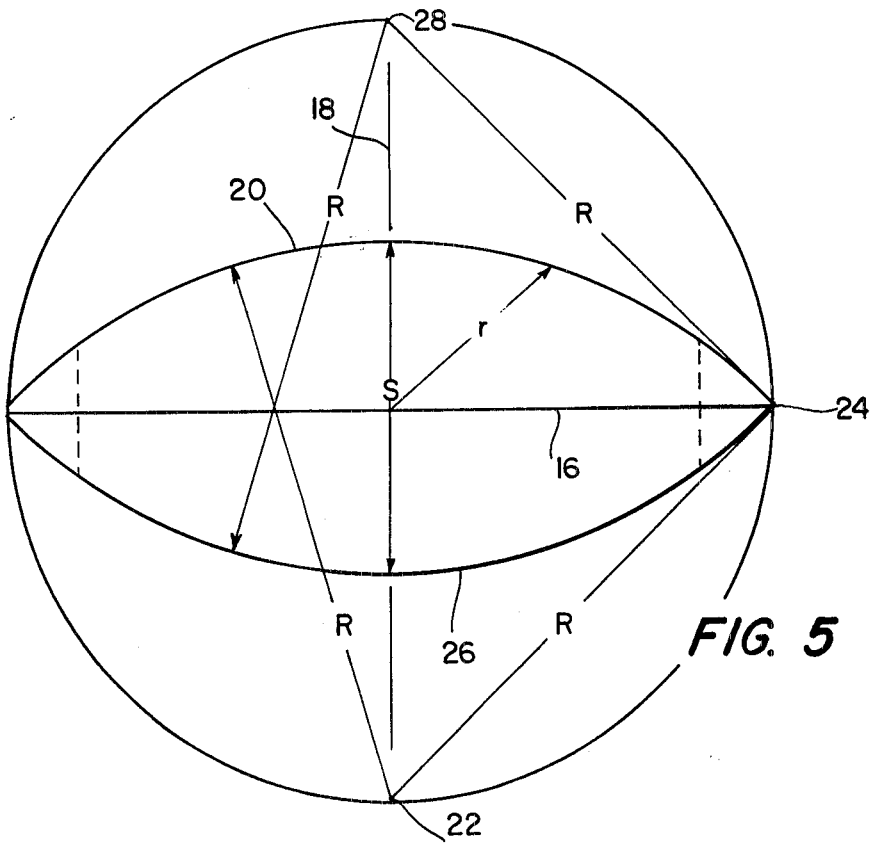
FIG. 5 is a sperical surface used to form the spherical cap lens portions.

Referring to the drawings, there is shown by the separate views two spherical cap sections 10 and 12 made of thin aluminum or any other suitable material having a radius of curature (R) as shown in FIG. 5 where R is related to the on-axis separation (S) by the formula $S=R(2-\sqrt{2})$. Each of the spherical surface sections subtend an angle of $2\theta$ from the center of the lens structure where $\theta$ is half the effective coverage angle of the spherical surface section. The spherical sections are separated by medium 14 such as TEFLON, polystyrene or polyethylene having a variable index of refraction where the index of refraction varies radially from the center line (or axis) to the outer edges of the lens surfaces, in accordance with the formula $n=2/(1+r^2)$, r being the radius from the center of the lens.

Figure 2:
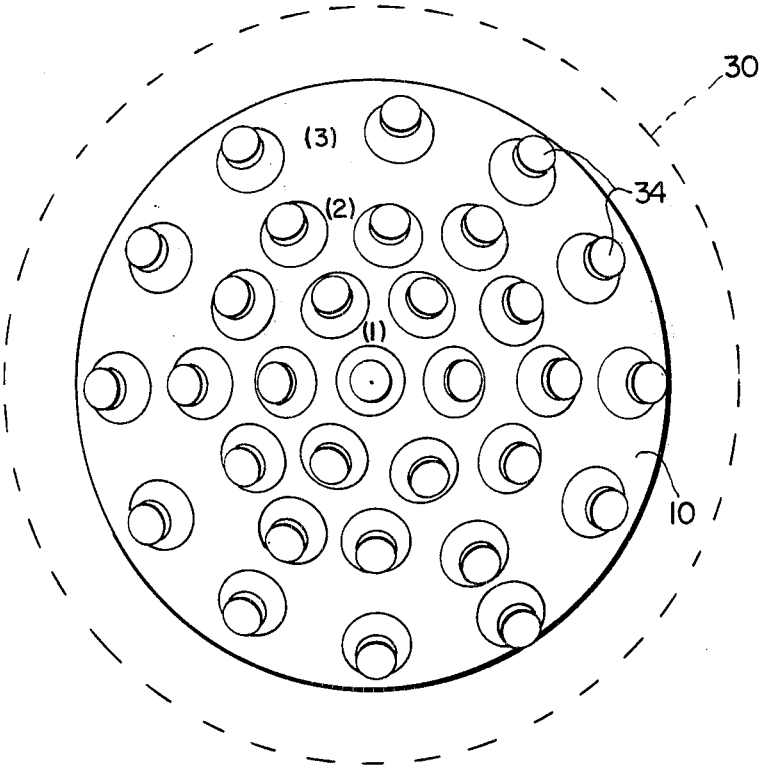
FIG. 2 is a top view illustrating the arrangment of the lens ports.
Figure 3:
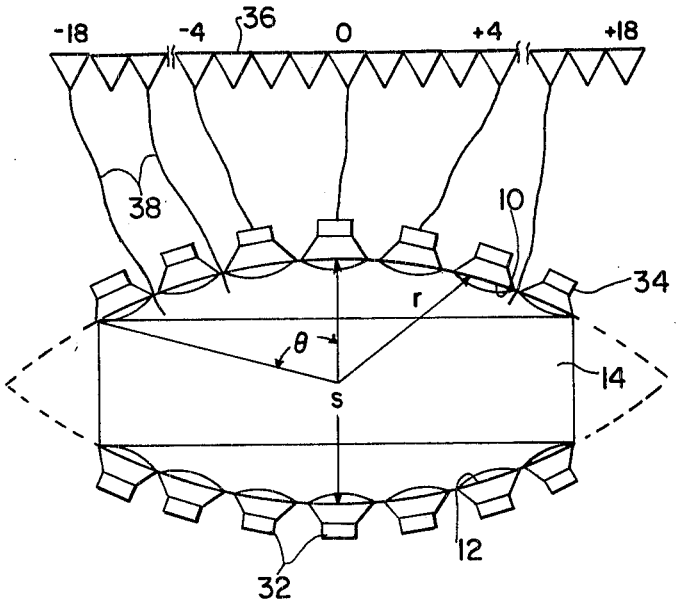
FIG. 3 is a side view.
Figure 4:
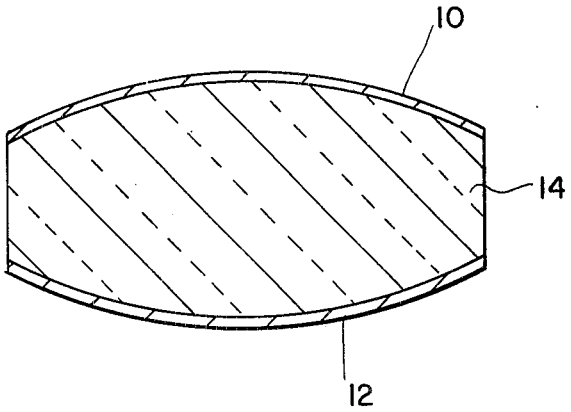
FIG. 4 is a cross sectional of the lens without the ports thereon.

The spherical cap sections are formed as follows: using FIG. 5 as a reference, a circle is drawn with horizontal and vertical axes 16 and 18. An arc 20 drawn about point 22 having a radius R, where R is the distance between the interception of the vertical axis with the circle at 22 and the interception of the horizontal axis and the circle at 24. Likewise an arc 26 is drawn with the radius R about the point 26 on the vertical axis at the circle. The upper and lower spherical caps are then formed by the spherical surfaces generated when the arcs 20 and 26 are simultaneously rotated about the virtural axis. The final spherical cap structure is formed by removing an outer rim portion as depicted by the dotted line 30 in FIG. 2 and shown in FIGS. 3 and 5. The portion removed is between the solid line and the dotted line and from one spherical cap to the other. The spacing between the two spherical caps is filled with the variable index of refraction material 14. The two spherical caps are separated from each other by a distance S with the edge of the spherical surface forming an angle $\theta$ with the axis line, with its vertex on the axis at the center of the lens.

Figure 6:
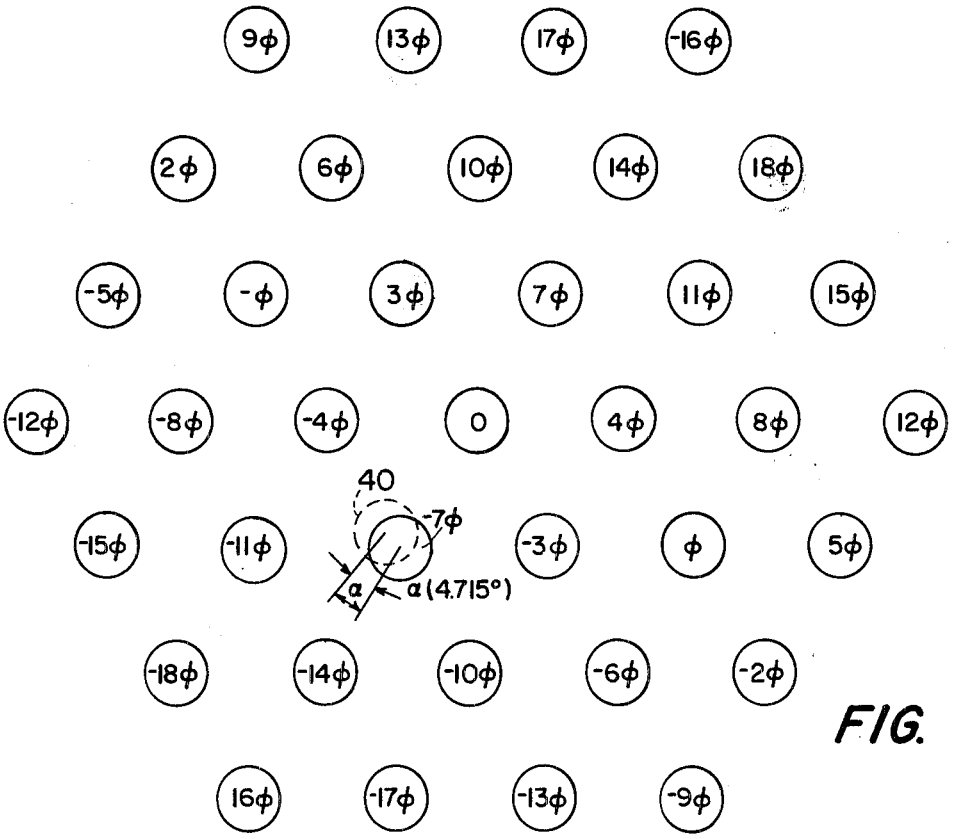
FIG. 6 illustrates a projection of the lens ports onto a planar surface with the phase distribution generated by a feed port indicated.
Figure 7:
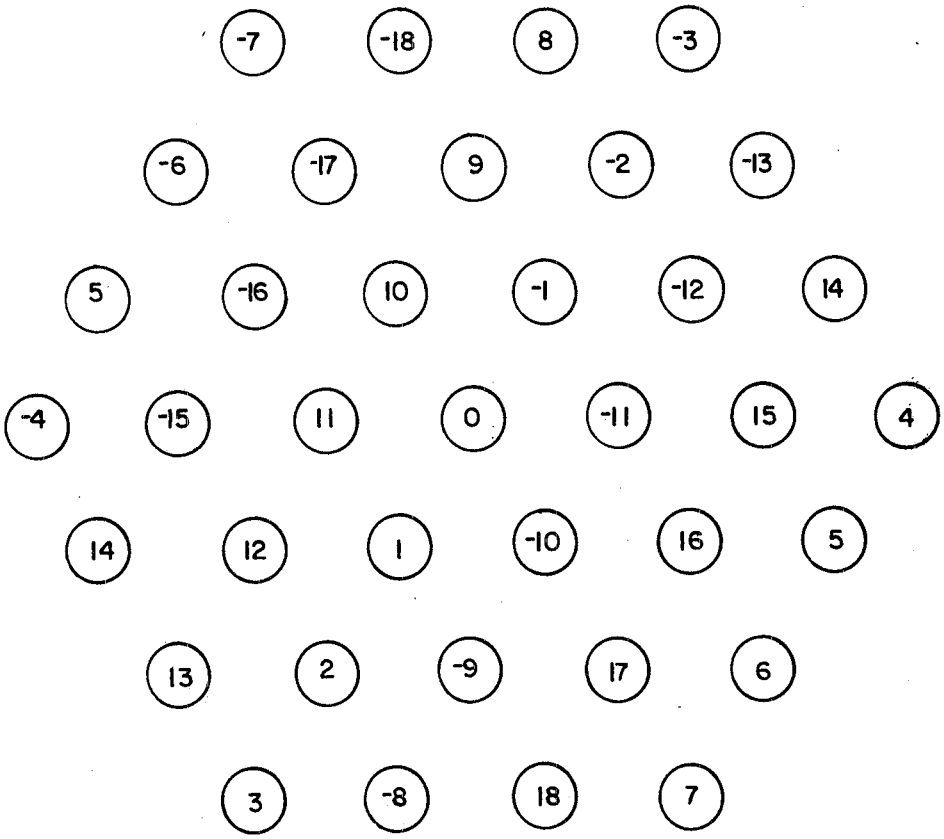
FIG. 7 illustrates the beam positions assigned to feed ports corresponding to linear array assignments of the lens ports of FIG. 2.

In the system described herein, each surface of the spherical surface is provided with thirty-seven radiators. The radiators on one surface form feed ports 32 and the radiators on the other surface form lens ports 34. The lens ports are connected to a linear or planar radiating antenna array 36 by use of equal-length coaxial transmission lines 38. The thirty-seven feed ports and the thirty-seven lens ports are arranged on the spherical surface so that their projection onto a planar surface forms a triangular-grid hexagonal array as shown in FIG. 6. The polarization of the feed and lens ports is arbitrary so long as all of them on the same surface have the same polarization and the polarizations of the two surfaces are matched.

FIG. 6 illustrates the phase distribution generated by a feed port 40, shown by a dotted circle, which is located as shown. The feed port array is rotated clockwise relative to the lens port array by an angle of 4.715 degrees, as shown. The feed ports must be rotated relative to the lens ports in order to form a progression of phases with the number of radiators distributed between $2\theta$. The displacement angle depends on the size of the array and the number of rings of radiators surrounding the center radiator. The twist angle $\alpha$ may be formed by the formula, $$\tan \alpha = \frac{1}{(2k+1)\sqrt{3}},$$

where k is the number of rings of radiators surrounding the center radiator. With thirty-seven radiators (3 rings) the angle is 4.715. The following chart may be used for the number (N) of radiators where $N=3k^2+K+1$.

| No. of radiators | No. of rings | Twist Angle |
|---|---|---|
| (N) | (K) | ($\alpha$) |
| 7 | 1 | 10.893 |
| 19 | 2 | 6.587 |
| 37 | 3 | 4.715 |
| 61 | 4 | 3.671 |

Figure 1:
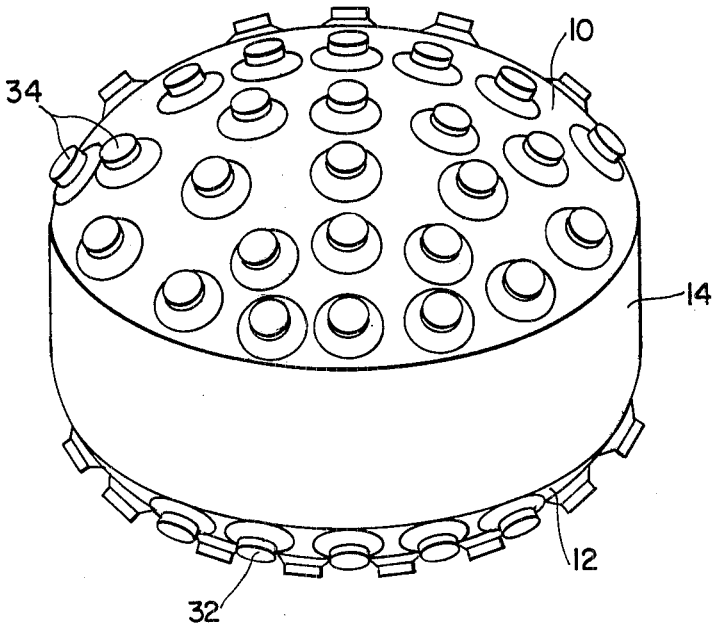
FIG. 1 is a perspective view of the three dimensional lens.

The phase excitations of the lens port array are for a linear radiating antenna array as shown in FIG. 1 where $\theta=2\pi/37$ for the array of the lens ports.

The number shown in the circles representing the beam ports are numbered in accordance with their connections with the linear antenna array. The lens ports are numbered with zero corresponding to the center element which is located on the y-axis of the spherical surface section. The numbers of the radiating linear antenna array start with zero on the axis with the positive numbers from 1 to 18 to the right of zero and the negative numbers from 1 to 18 to the left of zero. The feed ports are located as shown in FIG. 6, where the number of the port indicates the position of the beam generated by the linear antenna array relative to the central beam generated by the zero port. The positions of the feed ports are rotated 4.715 degrees clockwise relative to the lens ports.

The numerical assignments of the lens ports and feed ports are seen as linear progressions along any linear dimension provided the numbers are determined by modulo 37 arithmetic. Thus, the numerical assignments are completely determined by the center element, which is always zero, and any two adjacent elements. The lens port assignments can be defined by (3,4) and the feed port assignments by (1,10) where the number in parentheses are the two lowest positive numbers of the elements adjoining the center element.

The higher-order aberration produces a wavefornt error at the circumference of the aperture which varies strongly with the portion of the lens used. Allowing for the increased size of the lens under these conditions, the absolute value of the wavefront error varies as the fourth power of the angle $\theta$. (See FIG. 1).

This system can be operated in a transmitting mode or by reciprocity to receive a beam pattern which is the same as the transmit pattern. A signal to be transmitted can be coupled into any of the feed ports on the feed surface. The signal is transmitted through the nonuniform dielectric material to the spherical lens surface. The signal is directed from the variable-index-of-refraction material to the lens ports and into each of the 37 lens radiators and directed to the planar antenna array over the equal-length coaxial cables for excitation of the antenna elements. The lens ports are connected to the linear antenna array as shown in FIG. 6. Thus, the transmission signal will be directed to the antenna array from the axis outwardly in numerical order from the areas of the spherical lens ports surface, as shown.

In the receive mode, signals incident on the linear antenna array 36 will be conducted by the coaxial cable 38 to the lens ports 34, through the spherical surface section 10 and through the nonuniform dielectric material 14 to the spherical surface section 12. The signals from the separate antenna elements will be incident on the spherical surface section 12 as shown in FIG. 6. The feed ports 32 placed at these areas will direct the signal to the receiver and on to the processing equipment not shown for simplification of the drawing.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A three dimensional lens adapted to have electromagnetic energy transmitted thereacross for use in a planar antenna array comprising:

a first concave cap section including a plurality of radiators defining feed ports;

a second concave cap section including a plurality of radiators defining lens ports;

said concave cap sections facing each other and spaced apart on a central axis;

material filling the space between the facing concave cap sections having an index of refraction decreasing radially outwardly from a point on the central axis midway between the cap sections;

transmission lines connecting the lens ports with the planar antenna array;

whereby electromagnetic energy passing between said feed ports and lens ports is caused to take paths through the material whose path lengths are varied due to the changing index of refraction of the material for improved off-axis focusing of the antenna array for forming simultaneous multiple directive beams.

2. The invention according to claim 1 wherein the concave cap sections are spherically shaped and are spaced apart on the central axis by a distance of $S=R(2-\sqrt{2})$, where R is the radius of curvature of the concave cap sections.

3. The invention according to claim 1 or 2 wherein the index of refraction decreases according to the formula: $n=2/(1+r^2)$, where r is the radius from the midway point on the central axis.

4. A three dimensional lens adapted to have electromagnetic energy transmitted thereacross for use in a planar antenna array comprising:

a first spherical concave cap section including a plurality of radiators defining feed ports directed toward its center of curvature;

a second spherical concave cap section including a plurality of radiators defining lens ports directed toward its center of curvature;

said concave cap sections facing each other and spaced apart on a central axis by a distance of $S=R(2-\sqrt{2})$, where R is the radius of curvature of the concave cap sections;

material filling the space between the facing concave cap sections having an index of refraction decreasing radially from the central axis according to the formula: $n=2/(1+r^2)$, where r is the radius from a point on the central axis midway between the cap sections;

equal length coaxial transmission lines connecting the lens ports with the planar antenna array;

whereby electromagnetic energy passing between said feed ports and lens ports is caused to take paths through the material whose lengths are varied due to the changing index of refraction of the material for improved off-axis focusing of the antenna array for forming simultaneous multiple directive beams.

5. The invention according to claim 4 wherein the material filling the space between the facing spherical concave cap sections comprises a polymer.

6. The invention according to claim 5 wherein the polymer filling the space between the sherical concave cap sections is selected from the group consisting of teflon, polystyrene and polyethylene.

* * * * *